US006775649B1

(12) United States Patent
DeMartin

(10) Patent No.: US 6,775,649 B1
(45) Date of Patent: Aug. 10, 2004

(54) CONCEALMENT OF FRAME ERASURES FOR SPEECH TRANSMISSION AND STORAGE SYSTEM AND METHOD

(75) Inventor: Juan-Carlos DeMartin, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 300 days.

(21) Appl. No.: 09/639,193

(22) Filed: Aug. 15, 2000

Related U.S. Application Data

(60) Provisional application No. 60/151,846, filed on Sep. 1, 1999, and provisional application No. 60/167,198, filed on Nov. 23, 1999.

(51) Int. Cl.[7] ..... G10L 19/04; G10L 19/12

(52) U.S. Cl. ..... 704/201; 704/222; 704/230; 704/223

(58) Field of Search ..... 704/201, 200.1, 704/500, 230, 214, 226, 236, 222, 223

(56) References Cited

U.S. PATENT DOCUMENTS 5,732,389 A * 3/1998 Kroon et al. ..... 704/214
6,188,980 B1 * 2/2001 Thyssen ..... 704/230

OTHER PUBLICATIONS

DeMartin et al ("Improved Frame Erasure Concealment For CELP–Based Coders", IEEE International Conference on Acoustics Speech, and Signal Processing, Jun. 2000).*

Plenge et al ("Combined Channel Coding And Concealment", IEEE Colloquium On Terrestrial DAB—Where is it Going? ©1993.*

Chen et al ("A High–Fidelity Speech And Audio Codec With Low Delay And Low Complexity", IEEE International Conference on Acoustics, Speech, and Signal Processing, Jun. 2000).*

Parikh et al., ("Frame Erasure Concealment Using Sinusoidal Analysis–Synthesis And Its Application To MDCT–Based Codecs", IEEE International Conference on Acoustics, Speech, and Signal Processing, Jun. 2000).*

Hayashi et al ("Standardization Activity in ITU Of Extending 16–Kbit/S LD–CELP For Personal Communication Systems" Fourth IEEE International Conference on Universal Personal Communications ©1995).*

Li et al ("Error Resilient Video Transmission With Adaptive Stream–Shuffling And Bi–Directional Error Concealment", Oct. 2000).*

* cited by examiner

*Primary Examiner*—Richemond Dorvil
*Assistant Examiner*—Daniel A. Nolan
(74) *Attorney, Agent, or Firm*—Carlton H. Hoel; W. James Brady; Frederick J. Telecky, Jr.

(57) ABSTRACT

A decoder for packetized speech with differential quantization of line spectral frequencies and fixed-codebook gain conceals erased frames with interpolation of future and past frames by reconstruct future frame predicted parameters from presumed interpolations of erased frame parameters.

6 Claims, 4 Drawing Sheets

CONCEALMENT OF FRAME ERASURES FOR SPEECH TRANSMISSION AND STORAGE SYSTEM AND METHOD

CROSS-REFERENCE TO RELATED APPLICATIONS

This application claims priority from provisional applications: Serial No. 60/151,846, filed Sep. 1, 1999; and No. 60/167,198, filed Nov. 23, 1999. The following patent applications disclose related subject matter: Ser. No. 09/795,356, filed Nov. 3, 2000; Ser. No. 10/085,548, filed Feb. 27, 2002. These referenced applications have a common assignee with the present application.

BACKGROUND OF THE INVENTION

The invention relates to electronic devices, and, more particularly, to speech coding, transmission, storage, and decoding/synthesis methods and circuitry.

The performance of digital speech systems using low bit rates has become increasingly important with current and foreseeable digital communications. Both dedicated channel and packetized-over-network (e.g., Voice over IP) transmission benefit from compression of speech signals. The widely-used linear prediction (LP) digital speech coding compression method models the vocal tract as a time-varying filter and a time-varying excitation of the filter to mimic human speech. Linear prediction analysis determines LP coefficients a(j), j=1, 2, . . . , M, for an input frame of digital speech samples {s(n)} by setting $$r(n)=s(n)-\Sigma_{M\geq j\geq 1}a(j)s(n-j) \quad (1)$$

and minimizing $\Sigma r(n)^2$. Typically, M, the order of the linear prediction filter, is taken to be about 10–12; the sampling rate to form the samples s(n) is typically taken to be 8 kHz (the same as the public switched telephone network (PSTN) sampling for digital transmission); and the number of samples {s(n)} in a frame is often 80 or 160 (10 or 20 ms frames). A frame of samples may be generated by various windowing operations applied to the input speech samples. The name "linear prediction" arises from the interpretation of $r(n)=s(n)-\Sigma_{M\geq j\geq 1}a(j)s(n-j)$ as the error in predicting s(n) by the linear combination of preceding speech samples $\Sigma_{M\geq j\geq 1}a(j)s(n-j)$. Thus minimizing $\Sigma r(n)^2$ yields the {a(j)} which furnish the best linear prediction. The coefficients {a(j)} may be converted to line spectral frequencies (LSFs) for quantization and transmission or storage.

The {r(n)} form the LP residual for the frame and ideally would be the excitation for the synthesis filter 1/A(z) where A(z) is the transfer function of equation (1). Of course, the LP residual is not available at the decoder; so the task of the encoder is to represent the LP residual so that the decoder can generate the LP excitation from the encoded parameters. Physiologically, for voiced frames the excitation roughly has the form of a series of pulses at the pitch frequency, and for unvoiced frames the excitation roughly has the form of white noise.

The LP compression approach basically only transmits/stores updates for the (quantized) filter coefficients, the (quantized) residual (waveform or parameters such as pitch), and the (quantized) gain. A receiver regenerates the speech with the same perceptual characteristics as the input speech. Periodic updating of the quantized items requires fewer bits than direct representation of the speech signal, so a reasonable LP coder can operate at bits rates as low as 2–3 kb/s (kilobits per second).

Indeed, the ITU standard G.729 with a bit rate of 8 kb/s uses LP analysis with codebook excitation (CELP) to compress voiceband speech and has performance comparable to that of the 32 kb/s ADPCM in the G.726 standard. In particular, G.729 uses frames of 10 ms length divided into two 5 ms subframes for better tracking of pitch and gain parameters plus reduced codebook search complexity. The second subframe of a frame uses quantized and unquantized LP coefficients while the first subframe interpolates LP coefficients. Each subframe has an excitation represented by an adaptive-codebook part and a fixed-codebook part: the adaptive-codebook part represents the periodicity in the excitation signal using a fractional pitch lag with resolution of 1/3 sample and the fixed-codebook represents the difference between the synthesized residual and the adaptive-codebook representation. 10th order LP analysis with LSF quantization takes 18 bits.

G.729 handles frame erasures by reconstruction based on previously received information. Namely, replace the missing excitation signal with one of similar characteristics, while gradually decaying its energy by using a voicing classifier based on the long-term prediction gain, which is computed as part of the long-term postfilter analysis. The long-term postfilter sues the long-term filter with a lag that gives a normalized correlation greater than 0.5. For the error concealment process, a 10 ms frame is declared periodic if at least one 5 ms subframe has a long-term prediction gain of more than 3 dB. Otherwise the frame is declared nonperiodic. An erased frame inherits its class from the preceding (reconstructed) speech frame. Note that the voicing classification is continuously updated based on this reconstructed speech signal.

Leung et al, Voice Frame Reconstruction Methods for CELP Speech Coders in Digital Cellular and Wireless Communications, Proc. Wireless 93 (July 1993) describes missing frame reconstruction using parametric extrapolation and interpolation for a low complexity CELP coder using 4 subframes per frame. In particular, Leung et al proceeds as follows: For frame gain, perform scalar linear extrapolation or interpolation. For LPC coefficients, perform vector linear extrapolation or interpolation (i.e., matrices of extrapolation or interpolation acting of vectors of LPC coefficients to yield reconstructed LPC coefficients). For pitch lag and adaptive codebook coefficients (which are generated for each of the 4 subframes per frame), do median filtering to reconstruct the pitch lag (adjust the pitch search to insure a smooth pitch contour); and adopt a conditional repeat strategy to reconstruct the adaptive codebook coefficients. That is, a voicing decision is made initially for the missing frame by comparing the pitch lag median with the pitch lags in the previous and possibly future frames. If over half of the lags (4 per frame) are within ±5 samples from the median value, the missing frame is declared as voiced. The coefficients can be reconstructed according to one of three methods: (1) if the missing frame is estimated to be unvoiced, then select the scaled version of the coefficients associated with the pitch lag median, (2) if the missing frame is voiced and extrapolation used, then a scaled version of the coefficients of the last subframe of the preceding frame is used, and (3) if the missing frame is voiced and interpolation used, then a scaled version of the coefficient from either the last subframe of the preceding frame or the first subframe of the next frame could be used depending upon whether the pitch median comes from the preceding frame or the next frame. For stochastic excitation gain (generated for each subframe) do vector linear extrapolation or interpolation (i.e., matrices of extrapolation or interpolation acting of vectors of gains to yield reconstructed gains). For stochastic codebook parameters chose random values because of the lesser perceptual importance of these parameters and the fact of the relatively unpredictable behavior of the stochastic excitation.

However, this extrapolation or interpolation method does not apply to differentially quantized parameters.

SUMMARY OF THE INVENTION

The present invention provides concealment of erased frames which had been differentially quantized by the use of nonlinear interpolation of prior and future received frame information.

This has advantages including the preferred embodiment use of the time delay and future frame availability of a playout buffer (e.g., as in packetized CELP-encoded voice transmission over a network, including VoIP) for estimating missing parameters for concealment.

DETAILED DESCRIPTION OF THE PREFERRED EMBODIMENTS

1. Overview

The preferred embodiment methods of concealment of frame erasures in speech transmissions employ both past and future frames and estimate differentially quantized parameters; a nonlinear interpolation. The use of future frames implies time delay, but several systems such as voice over packet networks with playout buffers (used at the receiver to control jitter) already have future frames available and the preferred embodiments take advantage of the existing time delay.

Figure 1:
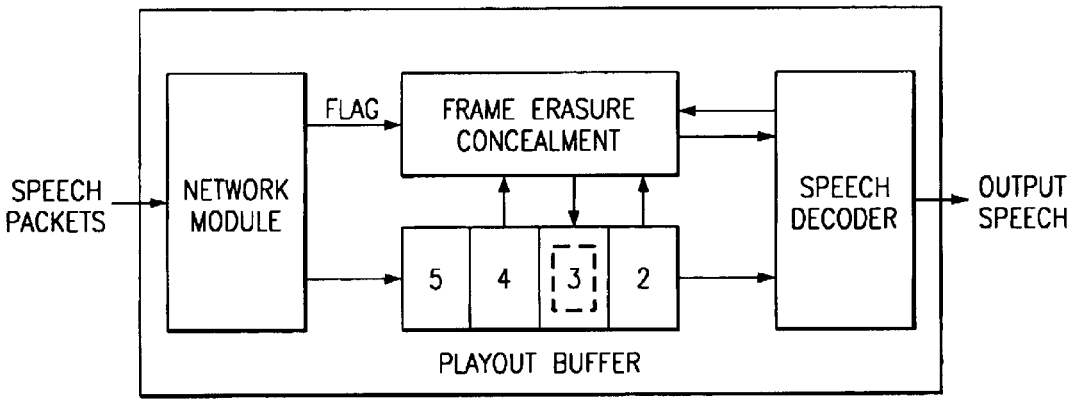
FIG. 1 shows first preferred embodiments.

Preferred embodiment systems and receivers incorporate preferred embodiment methods of error concealment. FIG. 1 illustrates a preferred embodiment receiver for a packet-based system such as VoIP (voice over internet protocol). Packets arriving from the network are first processed by the network module. Statistics are collected, packets ordered and transferred to the playout buffer. If near the time of playout the packet has not yet arrived, it is declared lost and the frame erasure concealment module reconstructs it using both past and future frames. In the figure, missing packet 3 is reconstructed by interpolating the previous packet 2 and following (future) packet 4.

2. First Preferred Embodiments With G.729

Figures 1, 2A:
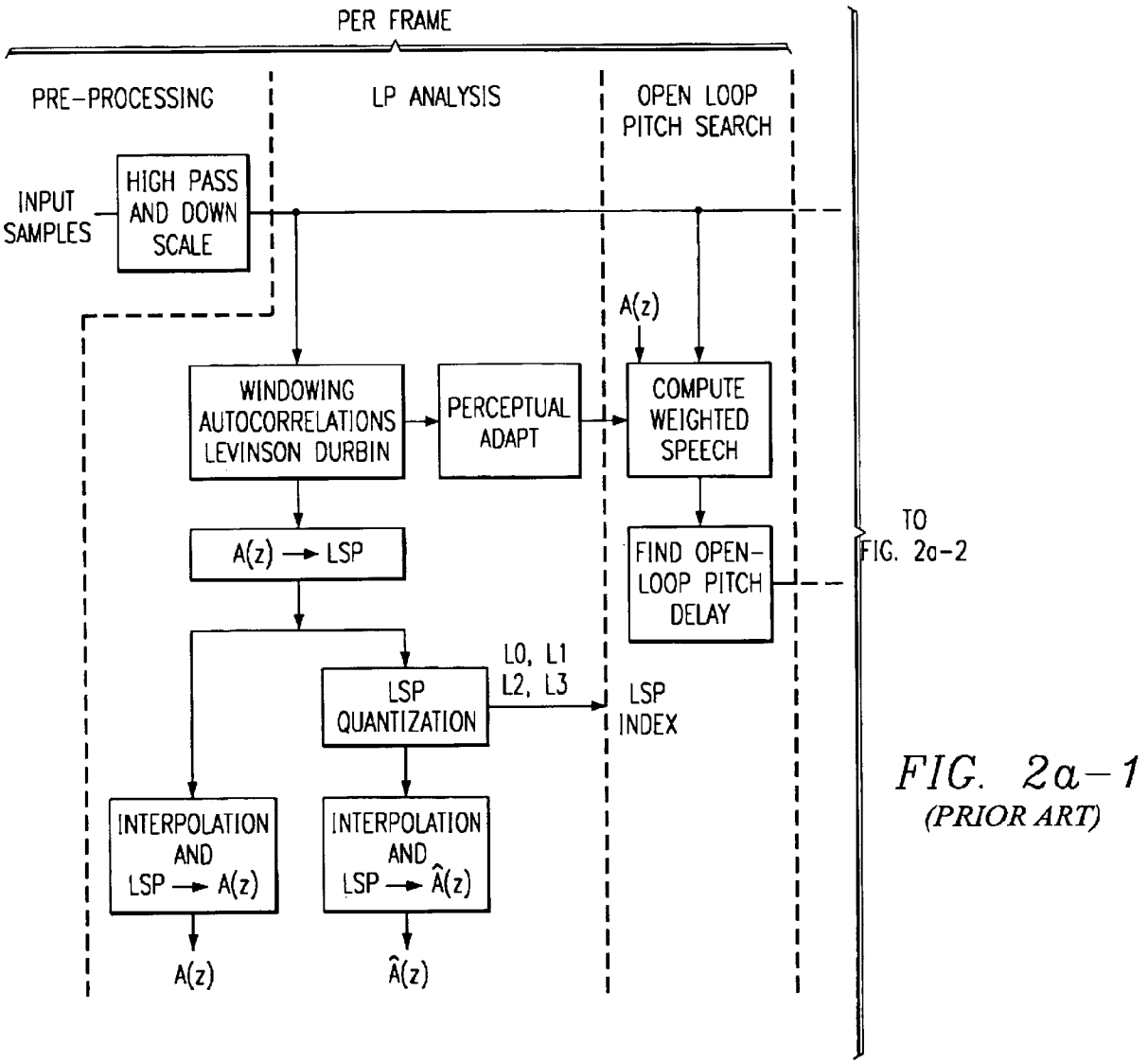
FIG. 2a-1 (PRIOR ART)
FIGS. 2*a*–2*b* are schematic diagrams of G.729 encoder and decoder.
Figures 2, 2A:
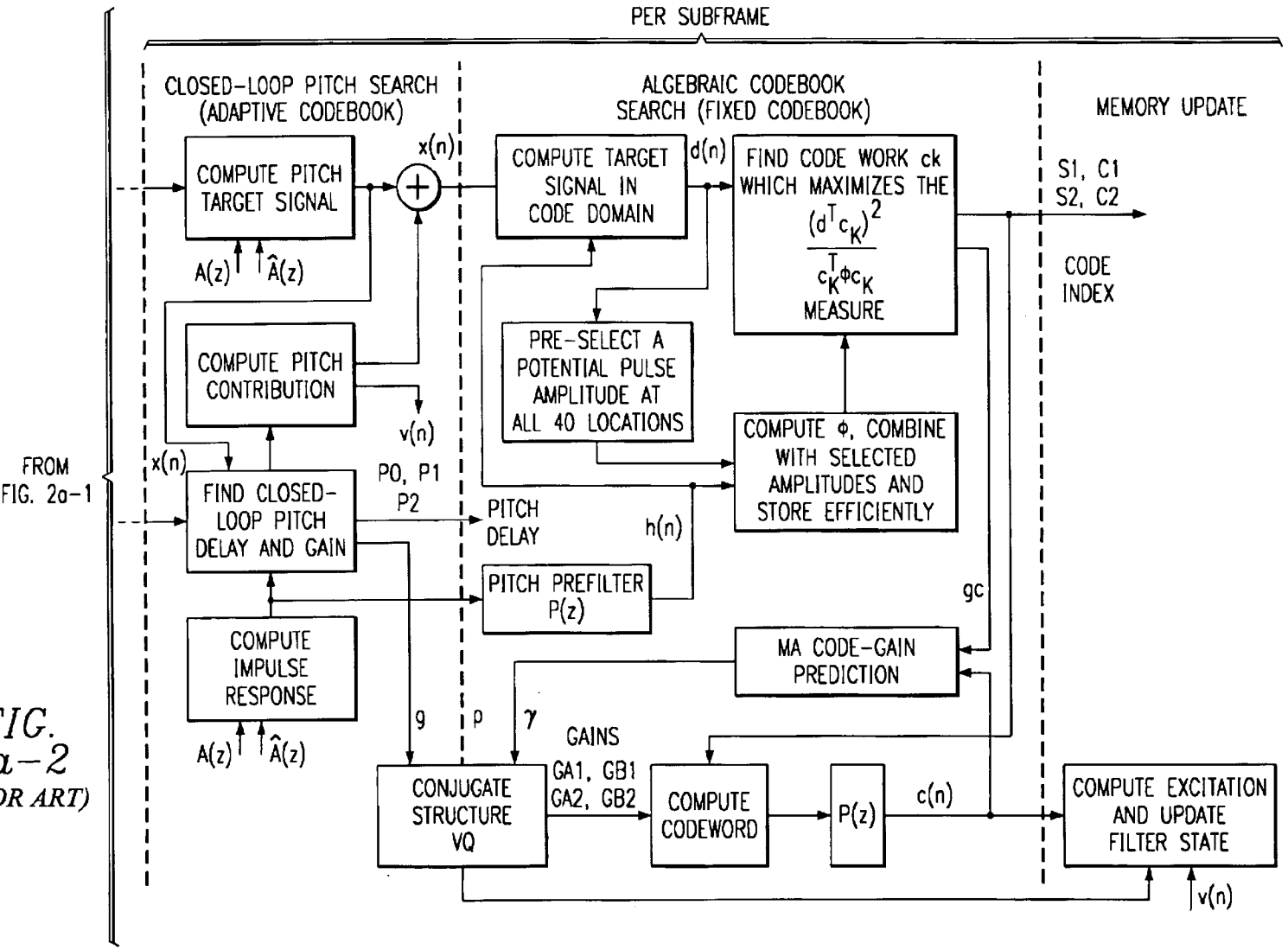
FIG. 2a-2 (PRIOR ART)
Figure 2B:
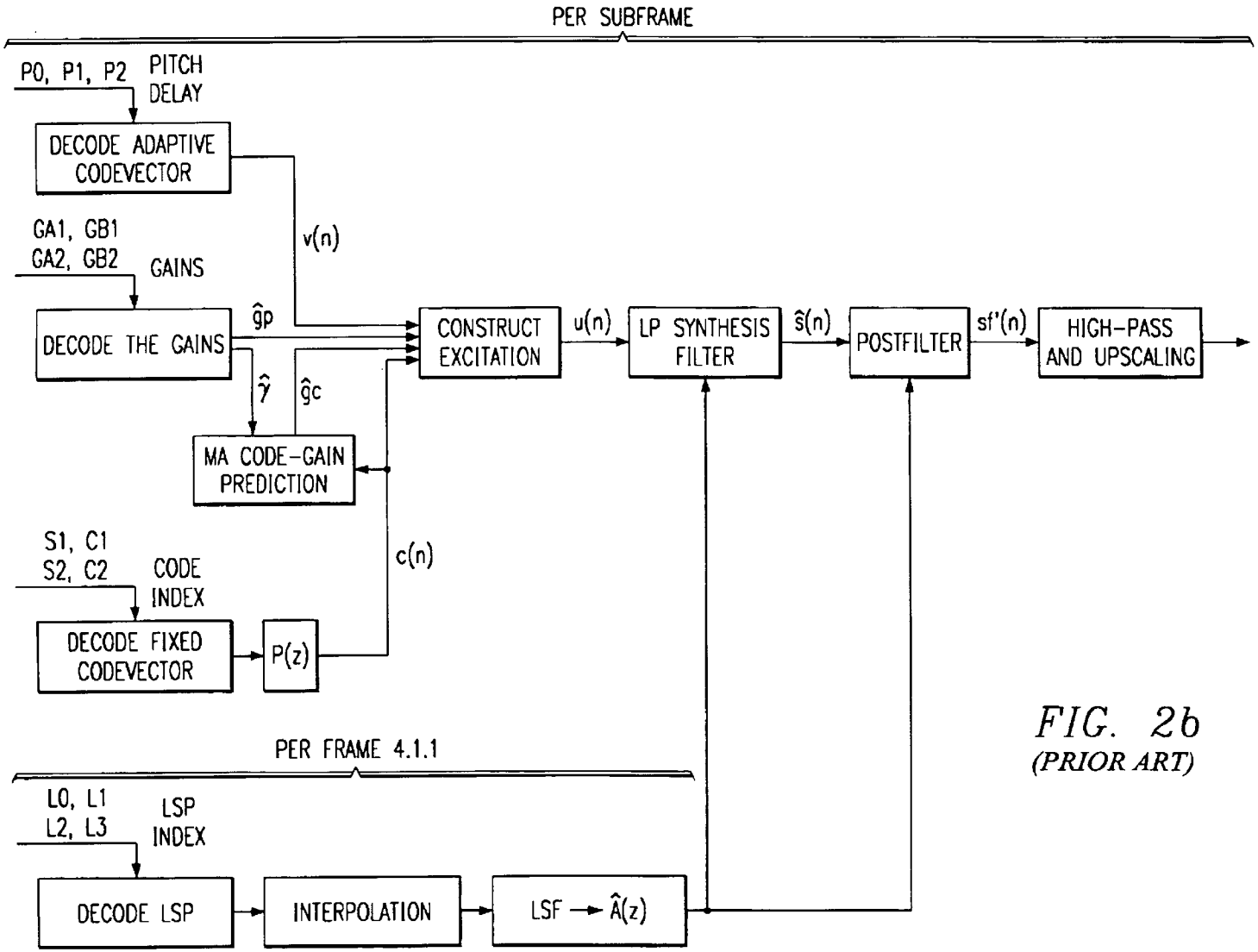
FIG. 2b (PRIOR ART)

FIG. 1 shows in functional block format a first preferred embodiment concealment method useful with G.729 encoded speech. G.729 encoding uses 80 bits for every 10 ms frame as follows: line spectrum pairs 18 bits, adaptive codebook index 13 bits split into 8 bits for the first 5 ms subframe and 5 bits for the second subframe, parity 1 bit, fixed codebook index 26 bits split into 13 for each subframe, fixed codebook pulse signs 8 bits split into 4 bits for each subframe, codebook gains 6 bits split as 3 and 3 for stage 1 plus 8 bits split as 4 and 4 for stage 2. FIGS. 2*a*–2*b* illustrate G.729 encoder and decoder. The first preferred embodiments handle these items as follows.

LSFs.

The LSFs for frame m are denoted $\omega_i[m]$ for i=1, 2, . . . , 10. The G.729 standard computes estimates $\omega_i[m]$ from the quantized codebook outputs which are differences between LSFs and predicted LSFs based on a moving average of M prior frames. In particular, $$\omega_i[m]=(1-\Sigma_{1\leq k\leq M}p_{i,k})\hat{l}_i[m]+\Sigma_{1\leq k\leq M}p_{i,k}\hat{l}_i[m-k] \quad (*)$$

where the $p_{i,k}$ are the coefficients of the moving average predictor and $\hat{l}_i[m]$ and $\hat{l}_i[m-k]$ for k=1, 2, . . . , M are the codebook outputs for frame m plus M prior frames. (G.729 takes M=4.) There are two predictors (two sets of coefficients) and a bit switches between the two predictors, one strong predictor and one weak predictor, to accommodate change. At the mth frame the vector to be quantized to form $\hat{l}_i[m]$ is the normalized difference between the LSF and the predicted LSF:

$$\hat{l}_i=(\omega_i[m]-\Sigma_{1\leq k\leq M}p_{i,k}\hat{l}_i[m-k])/(1-\Sigma_{1\leq k\leq M}p_{i,k})$$

where the initial conditions are $\hat{l}_i[j]=i\pi/11$ for j<0.

The first preferred embodiments compute the estimates $\omega_i[m]$ for an erased frame m essentially by linear interpolation of the estimates for the preceding frame plus the future frame; namely $\omega_i[m]=(\omega_i[m+1]+\omega_i[m-1])/2$. Of course, $\omega_i[m+1]$ in G.729 depends upon $\hat{l}_i[m]$ which was erased, so proceed as follows.

First, solve equation (*) for $\hat{l}_i[m]$:

$$\hat{l}_i[m]=(\omega_i[m]-\Sigma_{1\leq k\leq M}p_{i,k}\hat{l}_i[m-k])/(1-\Sigma_{1\leq k\leq M}p_{i,k})$$

Then substitute $\omega_i[m]=(\omega_i[m+1]+\omega_i[m-1])/2$ in to yield:

$$\hat{l}_i[m]=(\omega_i[m+1]/2+\acute{\omega}_i[m-1]/2-\Sigma_{1\leq k\leq M}p_{i,k}\hat{l}_i[m-k])/(1-\Sigma_{1\leq k\leq M}p_{i,k})$$

Next, use equation (*) for frame m+1:

$$\omega_i[m+1]=(1-\Sigma_{1\leq k\leq M}p_{i,k})\hat{l}_i[m+1]+\Sigma_{1\leq k\leq M}p_{i,k}\hat{l}_i[m+1-k]$$

and substitute the equation for $\hat{l}_i[m]$ into the k=1 term of the last sum to give:

$$\omega_i[m+1]=(1-\Sigma_{1\leq k\leq M}p_{i,k})\hat{l}_i[m+1]+\Sigma_{2\leq k\leq M}p_{i,k}\hat{l}_i[m+1-k]+(\omega_i[m+1]/2+\acute{\omega}_i[m-1]/2-\Sigma_{1\leq k\leq M}p_{i,k}\hat{l}_i[m-k])/(1-\Sigma_{1\leq k\leq M}p_{i,k})$$

Note that no frame m terms appear in this equation. Simplifying yields:

$$\omega_i[m+1]=(b_i\hat{l}_i[m+1]+a_i\omega_i[m-1]-2a_i\Sigma_{1\leq k\leq M}p_{i,k}\hat{l}_i[m-k]+\Sigma_{2\leq k\leq M}p_{i,k}\hat{l}_i[m+1-k])/(1-a_i) \quad (**)$$

where $a_i=p_{i,1}/2b_i$ and $b_i=(1-\Sigma_{1\leq k\leq M}p_{i,k})$.

Thus the nonlinear interpolation for reconstruction of the erased frame m proceeds through the following steps (1)–(3):

(1) Compute $\omega_i[m+1]$ using equation (**), this gives the future frame LSFs without using any frame m terms.

(2) Compute $\omega_i[m]$ using $\omega_i[m]=(\omega_i[m+1]+\acute{\omega}_i[m-1])/2$ where $\omega_i[m+1]$ comes from step (1) and $\omega_i[m-1]$ is from the preceding frame.

(3) Compute $\hat{I}_i[m]=(\omega_i[m]-\Sigma_{1\leq k\leq M}p_{i,k}\hat{I}_i[m-k])/(1-\Sigma_{1\leq k\leq M}p_{i,k})$ and use this to update the moving average predictor memory.

Voicing Classification.

Advanced error concealment methods for erased speech frames rely on the voicing of the missing frame: different strategies are followed depending on whether the frame is declared voiced or unvoiced. Because the actual voicing of the missing frame is unknown, it is usually assumed that the missing frame has the same voicing as the last correctly received frame. This is clearly non-optimal if the missing frame happens to be at a time of voicing transition between voiced to unvoiced segments or vice versa.

If future gain and pitch information, as assumed here, is available the voiced/unvoiced classification can be entirely avoided. Gains and pitch, infact, can be interpolated, and the regular procedure of generating an excitation signal composed of a fixed-codebook contribution and an adaptive codebook contribution can be followed.

Pitch and Gains

G.729 utilizes an excitation of the LP synthesis filter in each of the two 40-sample subframes per frame; the excitation has the form $$u(n)=\hat{g}_P v(n)+\hat{g}_C c(n)$$

where $\hat{g}_P$ is the quantized adaptive-codebook gain $g_P$, v(n) is the adaptive-codebook vector which is just a pitch delay-interpolation of the prior frame excitation u(n), $\hat{g}_C$ is the quantized fixed-codebook gain $g_C$, and c(n) is the fixed-codebook vector of four pulses (algebraic codebook) with harmonic enhancement. The fixed-codebook gain $g_C$ is predicted from prior frames analogous to the LSF predictions, so the preferred embodiments generate $g_C$ for the subframes of an erased frame in a manner analogous to the preceding for the LSFs.

In more detail, G.729 proceeds as follows. First, pitch analyses (open-loop and then closed-loop) use correlations of shifts of the (perceptually weighted) speech signal and the reconstructed speech signal to find a delay with fractional sample resolution. The pitch delay is encoded with a total of 14 bits per frame (8 bits plus a parity bit for the first subframe and 5 bits for the second subframe).

Next, apply the pitch delay to the prior frame excitation u(n) by interpolation to yield an excitation v(n) which LP synthesizes to y(n). The adaptive codebook gain $g_P=\langle x|y\rangle/\langle y|y\rangle$ where x(n) is the perceptually-weighted LP synthesized residual.

Then the difference $x(n)-g_P y(n)$ becomes the target for a search to find a fixed-codebook gain $g_C$ plus excitation c(n) for minimization of $(x(n)-g_P y(n)-g_C z(n))^2$ where z(n) is perceptually-weighted LP synthesized c(n).

where $\check{g}_C$ is a predicted gain based on previous fixed-codebook energies and γ is a correction factor. The mean energy of c(n) is $$E=10\log(\Sigma_{0\leq j\leq 39}c(j)^2/40)$$

Thus the energy of $g_C c(n)$ is $E+20\log(g_C)$. Then define the mean-removed energy at subframe m by $$E(m)=20\log(g_C(m)).+E-\bar{E}$$

where $\bar{E}$=30 dB is the mean energy of the fixed-codebook excitation. The gain $g_C(m)$ can be expressed in terms of E(m), E, and $\bar{E}$:

$$20\log(g_C(m))=E(m)+\bar{E}-E$$

The predicted gain $\check{g}_C(m)$ is found by predicting the log-energy of the current frame fixed-codebook contribution from the log-energy of previous frame fixed-codebook contribution:

$$\check{E}(m)=\Sigma_{1\leq i\leq 4}b_i\check{U}(m-i)$$

where $\check{U}(m)$ is the quantized version of the prediction error at subframe m, defined by $U(m)=E(m)-\check{E}(m)$. The predicted gain $\check{g}_C(m)$ is found through replacement of E(m) by its predicted value in the foregoing equation for $g_C(m)$ in terms of E(m), $\check{E}$, and E $$20\log(\check{g}_C(m))=\check{E}(m)+\check{E}-E$$

The correction factor γ(m) relates to the gain prediction error by U(m)=20 log(γ(m)). The adaptive-codebook gain $g_P$ and γ are vector quantized using a two-stage conjugate structured codebook; the first stage consists of a 3-bit two-dimensional codebook and the second stage consists of a 4-bit two-dimensional codebook. The first element in each codebook represents the quantized adaptive-codebook gain $\hat{g}_P$ and the second element represents the quantized fixed-codebook gain correction factor.

For the case of frame m missing, but frames m+1 and m−1 plus earlier frames available, the adaptive-codebook gain $g_P$ can be interpolated from frames m+1 and m−1 to give a value for frame m, and the fixed-codebook gain correction factor γ can also be interpolated from frames m+1 and m−1 to give a value for frame m. But the predicted fixed-codebook gain $\check{g}_C$ for frame m+1 uses the U(m) from missing frame m. Thus the preferred embodiments proceed analogously to the LSF prediction with missing frames. First, presume a linear interpolation of the fixed-codebook gain:

$$g_C(m)=(g_C(m-1)+g_C(m+1))/2$$

Now $$20\log(\check{g}c(m+1))=\check{E}(m+1)+\check{E}-E$$
$$=\Sigma_{2\leq i\leq 4}b_i\check{U}(m+1-i)+b_1\check{U}(m)+\check{E}-E$$

Use $$U(m)=E(m)-\check{E}(m)$$
$$=20\log(gc(m))+E(m)-\check{E}-\Sigma_{1\leq i\leq 4}b_i\check{U}(m-i)$$
$$=20\log((gc(m-1)+gc(m+1))/2)+E(m)-\check{E}-\Sigma_{1\leq i\leq 4}b_i\check{U}(m-i)$$

Analogous to the LSFs, the gain $g_C$ is predicted from a moving average of prior frame gains and differentially quantized. Indeed, G.729 sets $$g_C=\gamma\check{g}_C$$

Thus $$20\log(\check{g}_C(m+1))=\Sigma_{2\leq i\leq 4}b_i\check{U}(m+1-i)+b_1[20\log((g_C(m-1)+g_C(m+1))/2)-\Sigma_{1\leq i\leq 4}b_i\check{U}(m-i)]+E-E$$

Dividing by 20 $b_1$ and taking exponentials yields $$(\check{g}_C(m+1))^{1/b1}=A(g_C(m-1)+g_C(m+1))/2$$

where $\log(A)=(\Sigma_{2\leq i\leq 4}b_i\check{U}(m+1-i)-\Sigma_{1\leq i\leq 4}b_i\check{U}(m-i)]+\bar{E}-E)/20b_1$ So A is positive and known from frame m−1 plus earlier frames. Lastly, substituting $\check{g}_C(m+1)=g_C(m+1)/\gamma(m+1)$ gives $$(g_C(m+1))^{1/b1}(\gamma(m+1))^{-1/b1}-A(g_C(m+1)/2=ag_C(m-1))/2$$

Note that $b_1=0.68$, so $1/b_1=1.47$. This equation for $g_C(m+1)$ can be solved in terms of items from frame m−1 and earlier frames plus $\gamma(m+1)$. Then $g_C(m)$ for the missing frame m follows from the original assumption $g_C(m)=(g_C(m-1)+g_C(m+1))/2$.

Pitch

Obtain the pitch for an erased frame by median smoothing of the pitch from the immediately preceding and future frames. More specifically, the first pitch value for the missing frame is obtained by median smoothing of the two pitch values of the last correctly received frame and the first pitch value of the future frame. The second pitch value for the missing frame, instead, is computed as the median of the second pitch value of the last frame and the two pitch values of the future frame.

3. LSF-only Preferred Embodiments

The foregoing erased frame concealment for the LSFs can be used without the fixed-codebook gain concealment. Indeed, with past and future frames available, gains and pitch can be interpolated, and the regular procedure of generating an excitation signal composed of a fixed-codebook contribution and an adaptive codebook contribution can be followed.

4. Alternative Preferred Embodiments

Alternatives preferred embodiments change one or both of the presumed linear combinations $\omega_i[m]=(\omega_i[m+1]+\omega_i[m-1])/2$ and $g_C(m)=(g_C(m-1)+g_C(m+1))/2$ to other functions but otherwise proceed as in the foregoing. With other linear combinations (e.g., coefficients other than 1/2) the computations are similar, but with more involved functions, such as harmonic means, the computations become more involved.

5. System Preferred Embodiments

This section describes in algorithmic form preferred embodiment systems which use the preferred embodiment encoding and decoding in frames with two sub-frames.

5.a Pitch

Step 1. Order (increasing) vector formed by both pitch values of previous frame and first value of future frame;

Step 2. Select second (median) value as the pitch value to be used in first sub-frame of missing frame;

Step 3. Order (increasing) vector formed by second value of previous frame and both values of future frame;

Step 4. Select second (median) value as the pitch value to be used in second sub-frame of missing frame;

5.b Adaptive Codebook Gain

Step 1. Multiply last correctly received adaptive codebook gain by interpolation coefficient a (e.g., 0.75);

Step 2. Multiply first future adaptive codebook gain by (1−a);

Step 3. Set first adaptive codebook gain of missing frame to sum of values computed at steps 1 and 2;

Step 4. Multiply last correctly received adaptive codebook gain by interpolation coefficient b (e.g., 0.25);

Step 5. Multiply first future adaptive codebook gain by (1−b);

Step 6. Set second adaptive codebook gain of missing frame to sum of values computed at steps 4 and 5.

5.c Line Spectral Frequencies (LSF's)

Steps to be performed for each LSF (ten in number for G.729).

Step 1. Sum values of moving average (MA) predictor for future frame and subtract from 1.0;

Step 2. Multiply value computed at Step 1 by prediction LSF residual for future frame;

Step 3. Divide the value of the first MA predictor coefficient for future frame by two times value computed at step 1;

Step 4. Multiply LSF value for past frame by value computed at Step 3;

Step 5. Compute MA prediction of missing frame (based on LSF residual of last four frames in the case of G.729);

Step 6. Multiply value computed at Step 5 by two times the value computed at Step 4;

Step 7. Compute MA prediction of future frame LSF stopping at past frame value (i.e., in the case of G.729, using past frame residual and two residuals prior to that);

Step 7. Sum the values computed at Steps 2, 4 and 7;

Step 8. Subtract the value computed at Step 6 from value computed at Step 7;

Step 9. Divide value computed at Step 8 by value computed at step 3.

5.d Fixed Codebook Gain

Same steps as in 5.c using Fixed-Codebook Gain MA predictor coefficients.

6. Modifications

The preferred embodiments may be modified in various ways while retaining the features of erased frame estimation of parameters encoded as moving averages.

For example, the interpolation model for the LSF of the erased frame or the fixed-codebook gain could be varied, the moving average predictor coefficients and their number could be varied, and so forth.

What is claimed is:

1. A method of decoding, comprising:

(a) receiving a sequence of encoded frames including an erased frame, each of said encoded frames including a value of a parameter encoded as a moving average over said each frame plus M prior frames of the value of a quantity, where M is a positive integer;

(b) for said erased frame, estimating the value of said parameter by the steps of:

(i) modeling the value of said parameter for said erased frame as an interpolation of the values of said parameter for a frame prior to and a frame following said erased frame;

(ii) estimating the value of said parameter for said frame following said erased frame by use of the model of step (i) to eliminate the dependence of said value of said parameter on the value of said quantity for said erased frame; and (iii) using said model of step (i) and the estimate of step (ii) to estimate the value of said parameter for said erased frame.

2. The method of claim 1, further comprising:

(a) using said estimate of step (iii) claim 1 to estimate the value of said quantity for said erased frame.

3. The method of claim 1, wherein:

(a) said quantity is the output of a quantization codebook.

4. A decoder, comprising:

(a) an input to receive a sequence of encoded frames including an erased frame;

(b) circuitry programmed to estimate for each frame a value of a parameter encoded as a moving average over said each frame plus M prior frames of the value of a quantity, where M is a positive integer, with said estimating by the steps of:

(i) modeling the value of said parameter for said erased frame as an interpolation of the values of said parameter for a frame prior to and a frame following said erased frame;

(ii) estimating the value of said parameter for said frame following said erased frame by use of the model of step (i) to eliminate the dependence of said value of said parameter on the value of said quantity for said erased frame; and (iii) using said model of step (i) and the estimate of step (ii) to estimate the value of said parameter for said erased frame.

5. The decoder of claim 4, wherein:

(a) said circuitry also uses the estimate of step (iii) of claim 4 to estimate the value of said quantity for said erased frame.

6. The decoder of claim 4, wherein:

(a) said quantity is the output of a quantization codebook.

* * * * *